US006311839B1

(12) United States Patent
Lo

(10) Patent No.: US 6,311,839 B1
(45) Date of Patent: Nov. 6, 2001

(54) INTERACTIVE BLISTER PACKAGE

(75) Inventor: Peter Lo, Taipei Hsien (TW)

(73) Assignee: Excel Scientech Co., Ltd., Taipei (TW)

( * ) Notice: Subject to any disclaimer, the term of this patent is extended or adjusted under 35 U.S.C. 154(b) by 0 days.

(21) Appl. No.: 09/496,534

(22) Filed: Feb. 2, 2000

(51) Int. Cl.[7] ..... B65D 85/28
(52) U.S. Cl. ..... 206/371; 206/461
(58) Field of Search ..... 206/214, 224, 206/371, 461–471

(56) References Cited

U.S. PATENT DOCUMENTS

| | | | | |
|---|---|---|---|---|
| 2,850,152 | * | 9/1958 | Marrufo | 206/214 |
| 3,046,804 | * | 11/1962 | Stoffel | 206/371 |
| 3,127,010 | * | 3/1964 | Cappezuto | 206/470 |
| 4,039,079 | * | 8/1977 | Laughton | 206/461 |
| 5,154,293 | * | 10/1992 | Gould | 206/461 |
| 5,279,417 | * | 1/1994 | Seaton | 206/461 |
| 5,664,673 | * | 9/1997 | Perry | 206/371 |

* cited by examiner

*Primary Examiner*—Jim Foster
(74) *Attorney, Agent, or Firm*—Darby & Darby

(57) ABSTRACT

A package for an illuminating writing implement is provided which protects the writing implement, yet gives a consumer limited and controlled access to the operating mechanism used to activate the illumination of the writing implement while it remains packaged. The present package is a blister-type package which envelops the writing implement and protects it from abrasive and impact damage as well as, theft. An upper end of the writing implement includes a power switch which is linearly displaceable between an off position, a momentary-on position, and a locked-on position. An opening within the package allows the power switch to extend outside the package so that a consumer may operate the power switch without removing the writing implement from the package. The opening is sized and shaped to restrict linear displacement of the power switch between the off position and the momentary-on position. This switch limitation allows the consumer to momentarily test the illumination of the writing implement while preventing the switch from being moved to the locked-on position while the writing implement remains packaged.

8 Claims, 1 Drawing Sheet

INTERACTIVE BLISTER PACKAGE

BACKGROUND OF THE INVENTION a. Field of the Invention

The present invention relates to packaging, and more particularly, to interactive packaging for displaying battery-operated illuminating writing implements, including pens and mechanical pencils, and which allows consumers to interact with the writing implements while they remain packaged.

b. Description of the Prior Art

Blister packaging is commonly used today to contain and display a variety of products, typically suspended from a hanger rod in a store. The blister package usually includes three main sections, a main plastic backing section, a front plastic cover section, and an intermediate cardboard section. Each plastic section has been molded to conform to a portion of the product to be contained so that when assembled, the blister package secures the entire product between the two plastic sections. The cardboard section is usually included between the two plastic sections to provide a printable surface onto which product identification and operational instructions may be applied and easily viewed.

Some blister packages include only a single front plastic cover section which is bonded to a cardboard backing. In this instance, the plastic cover is shaped to conform to a front portion of the product, and the product is effectively secured within the package between the flat cardboard backing and the overlaid and conforming plastic cover section.

Blister packaging typically used to contain products such as household tools, including scissors, manicuring implements, kitchen utensils, and also shop tools, such as pliers, screw drivers, and flashlights. The plastic portions of the blister package are made of strong, transparent, and resilient plastic, such as polyvinyl chloride (PVC) and are either bonded to each other (in the two plastic section package) along a periphery of the package using an appropriate bonding technique, such as an adhesive or a heat weld, or simply bonded to one surface of the cardboard backing (in the case of a one plastic section package).

Regardless of the type of blister packaging, it completely encloses the article, making it impossible for the consumer to touch, operate, or otherwise test the article without first destroying the packaging.

Certain types of interactive packaging have been developed which allow consumers to touch or test a packaged article without removing the article from the package. Interactive packaging is any package that contains an article of manufacture and also provides some access to the article so that a consumer may handle and/or operate the article without opening or otherwise separating the article from its package. Interactive packaging may be paper, such as cardboard, or plastic, such as plastic blister-type packaging. This type of packaging is typically used to contain simple mechanical tools, such as pliers and scissors. The package is designed to hold a portion of the article, such as one handle of a pair of scissors, and yet provide access for a consumer to manipulate the other handle and therefore operate the scissors within the package. Although the freedom of operational movement of the article within the package is often less than that of an article removed from its package, even limited "hands on" interaction between the article and a potential consumer can be a selling advantage.

Flashlights are sometimes difficult items to display and sell. Since a flashlight is carried when used, a flashlight manufacture would want consumers to be able to hold and carry their flashlight prior to purchase, as the consumers compare different flashlight brands within a store. Although batteries are usually supplied separate from the flashlight (leaving the flashlight inoperative), since a consumer will also want to turn a flashlight on to compare the shape and intensity of the projected beam, some flashlights are displayed with batteries loaded and ready to use. The switch to these pre-loaded flashlights is usually accessible, allowing a consumer to handle and operate the flashlight within the store, prior to purchasing it.

Unfortunately, after testing the operation of a flashlight, some consumers may inadvertently leave it turned on within the store, quickly draining the batteries. A "dead" or dim flashlight could easily dissuade other consumers from buying what would appear to be an inferior product. U.S. Pat. No. 5,048,677 discloses a package for containing a straight barrel type flashlight having a head, an end-cap and an interposed barrel handle. This package secures the flashlight, yet allows a consumer to handle and operate the flashlight product. According to U.S. Pat. No. 5,048,677, the package is generally C-shaped and is secured to the head and end-cap of the flashlight, exposing the interposed barrel handle for the consumer to touch and hold.

Unfortunately, as discussed above, the package disclosed in U.S. Pat. No. 5,048,677 also exposes the power switch to the flashlight, leaving pre-loaded flashlights vulnerable to inadvertent power drain prior to their purchase.

A variety of writing implements include built-in illumination. This illumination is generated by an LED and is powered by batteries located within the housing of the writing implement. A button switch is used to control the flow of current between the batteries and the LED, and thereby controls the illumination. When activated, light from the LED will illuminate a portion of the writing implement, similar in operation to that of a conventional flashlight.

It is desirable to package these illuminated writing implements in a manner which protects the product, yet allows a consumer to test the illumination feature in a controlled manner.

SUMMARY OF THE INVENTION

The present invention relates to a package for an illuminating writing implement which protects the writing implement, yet also gives a consumer limited and controlled access to the operating mechanism used to activate the illumination of the writing implement, while the writing implement remains packaged. The present package is a blister-type package which envelops the writing implement and protects it from abrasive and impact damage, and theft. An upper end of the writing implement includes a power switch which is linearly displaceable between an off position, a momentary-on position, and a locked-on position. An opening within the package allows the power switch to extend outside the package so that a consumer may operate the power switch without removing the writing implement from the package. The opening is sized and shaped to restrict linear displacement of the power switch between the off position and the momentary-on position. This switch limitation allows the consumer to momentarily test the illumination of the writing implement, while preventing the switch from being moved to the locked-on position while the writing implement remains packaged.

BRIEF DESCRIPTION OF THE DRAWINGS

The foregoing and other features and aspects of the invention will be more readily apparent from the following detailed description taken in conjunction with the appended drawing wherein.

DETAILED DESCRIPTION OF THE INVENTION

Figure 1:
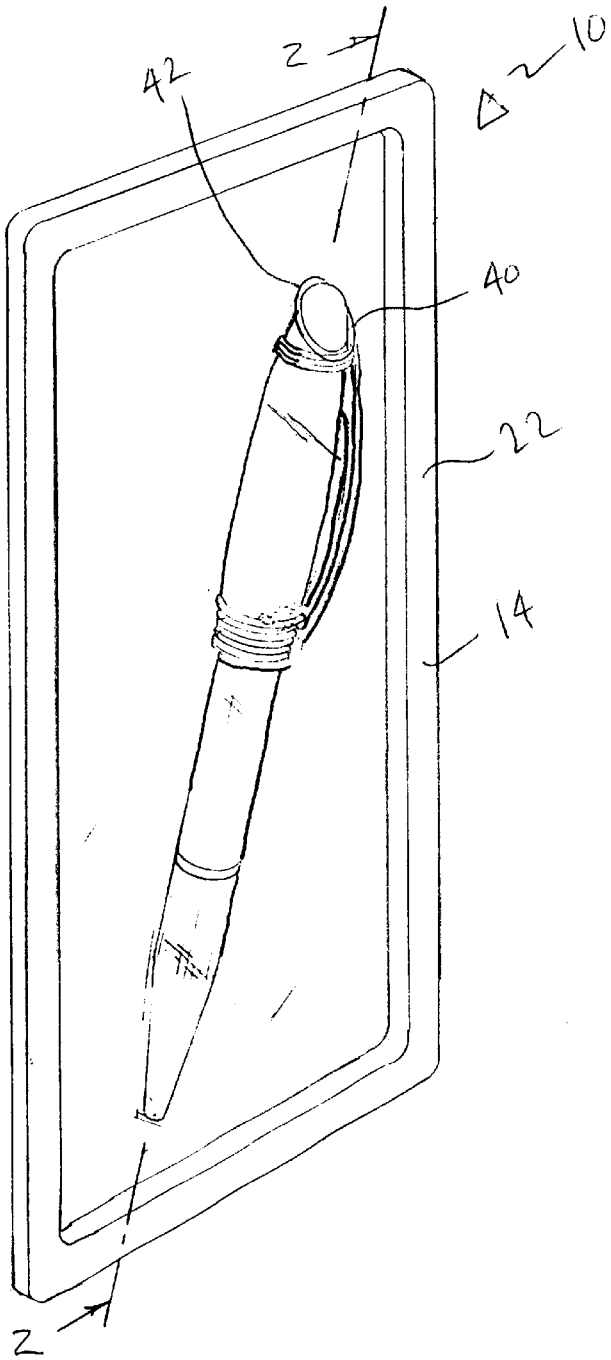
FIG. 1 is a perspective view of a package containing a writing implement, according to the invention.
Figure 2:
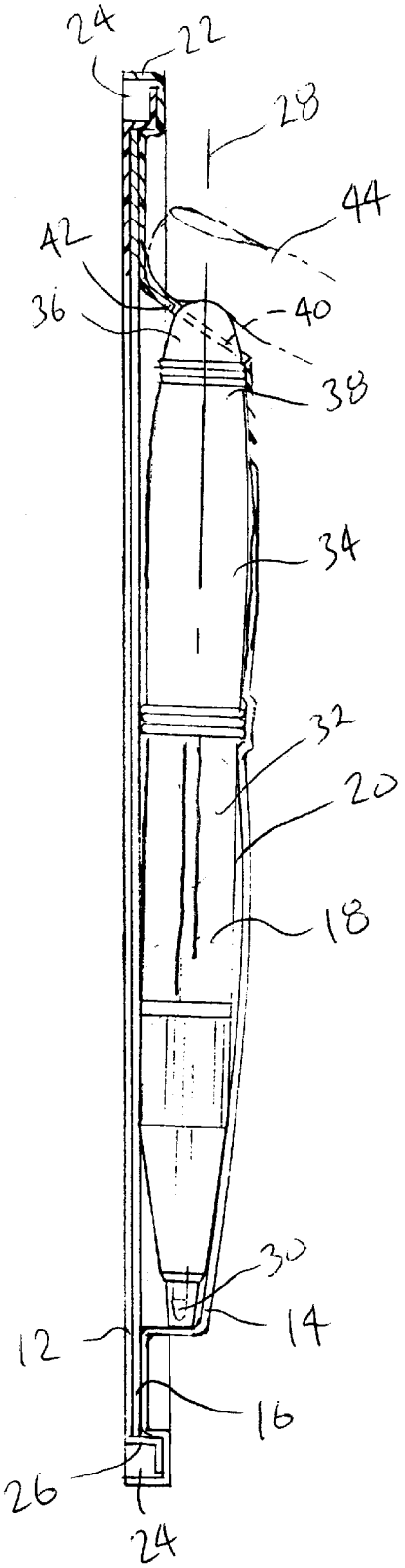
FIG. 2 is a sectional view of the package, taken along the line 2—2 in FIG. 1, showing the details of a switch of the writing implement and a switch opening of the package, according to the invention.

Referring to FIGS. 1 and 2, a generally rectangular blister-type package 10 is shown including a back panel 12 (see FIG. 2), a front panel 14, and an interposed card 16. The package 10 contains a writing implement 18 between card 16 and front panel 14. As is well known by those skilled in the art, a close-fitting recess 20 is vacuum-formed to snugly receive the writing implement 18, effectively immobilizing the writing implement 18 within recess 20. Front panel 14 further includes a peripheral edge 22 having a peripheral channel 24. A mating peripheral step 26 is formed along a peripheral edge of back panel 12. Mating peripheral step 26 is sized and shaped to snap-fit within channel 24 of front panel 14, closing the package 10 and securing the writing implement 18 between the front and back panels. As is known in the art, front panel 14 and back panel 12 may be alternately or additionally bonded to each other by other techniques, including adhesive, staples, and/or heat welding.

Writing implement 18 defines a longitudinal axis 28, and includes a tip 30, a barrel portion 32, a top cap 34, and a switch 36. An LED (not shown) and a battery (not shown) are located within the writing implement 18 and are electrically connected to each other and to the switch 36 in a manner well known in the art so that mechanical movement of the switch 36 controls the flow of electrical current between the batteries and the LED, thereby controlling the illumination of the writing implement 18.

According to this embodiment of the invention, the switch 36 is positioned at an upper end 38 of top cap 34 and is linearly moveable along the longitudinal axis 28 of the writing implement 18. Switch 36 is preferably of the type that is moveable between an off position wherein no current flows between the batteries and the LED (i.e., the writing implement 18 is not illuminated) and a locked-on position, wherein an electrical circuit is closed so that current flows between the batteries and the LED, thereby illuminating the LED. To activate the LED, with the writing implement located outside the package 10, a user depresses switch 36 downward until a click is heard, indicating that the switch 36 has reached the locked-on position. As the user releases the switch 36, the switch rises slightly but remains locked in the locked-on position and the LED will remain lit. To turn off the LED, the user must depress the switch 36 downwardly again, which will release the locked-on condition of the switch and allow a return spring (not shown) to return the switch to its off position. The switch 36 further includes a momentary-on position which is located between the off position and the locked-on position, and which causes current to flow between the batteries and the LED only as long as the user maintains sufficient downward force on the switch 36, without causing the switch to reach the locked-on position.

The mechanical action of the electrical switch 36 is similar to the mechanical action of a conventional ball-point pen, whereby a button located at an upper end of the pen may be depressed to extend (at an opposite end) a pen tip from a recessed position to a locked extended position. As is well known, the pen tip may be retracted by again, depressing the button to release the locking mechanism and then allowing the button and the pen tip to rise against the action of a spring to the retracted position. The Locking mechanism alternately locks and unlocks as long as the button is fully depressed.

According to the present invention, an access opening 40 is provided in the package 10, preferably through the front panel 14, as shown in the figures. The access opening 40 is carefully sized and shaped to receive a predetermined portion of switch 36, and may include a reinforced peripheral edge 42, however this is not necessary to carry out the present invention. Access opening 40 allows a predetermined portion of switch 36 to extend outside the package 10 so that a consumer shopping within a store may depress switch 36 using his or her finger 44 until the finger lies flush against the front panel 14 of the package 10 (adjacent to the opening 40). The size and shape of the opening 40 is such that the switch 36 may only be depressed to its momentary-on position, causing the LED to illuminate the writing implement 18 within the package 10, but only as long as the consumer continues to press down on the exposed switch 36. The snugly-fitting recess 20 keeps the writing implement 18 immobilized within the package 10, even as a consumer depresses switch 36.

The package 10, according to the invention, provides the benefit of allowing a consumer to sample or test the LED feature of the illuminating type writing implement 18 in a controlled and momentary manner.

While an illustrative embodiment of the invention has been described, it will be appreciated by those skilled in the art that the present invention is not limited by the description, but extends to those features within the spirit of the invention, being limited only by the appended claims.

What is claimed is:

1. An interactive package containing an illuminating writing implement of the type including an elongated body defining a longitudinal axis, a top cap, an LED, a battery, and a push-button switch, said switch including an off position, wherein current does not flow between the battery and the LED, a momentary-on position, wherein current flows between the battery and the LED as long as the switch is depressed, and a locked-on position, wherein current flows between the battery and the LED, said interactive package comprising:

a hollow shell defining a compartment, said compartment securely holding said illuminated writing implement along said longitudinal axis;

an opening within said shell and along said longitudinal axis, said opening receiving a portion of said switch therethrough so that a portion of said switch extends a predetermined distance outside said shell, said predetermined distance being sufficient to allow said switch to be depressed from outside said package from said off position to said momentary-on position, said predetermined distance being insufficient to allow said switch to be depressed to said locked-on position, said opening being sized and shaped to prevent passage of said body through said opening.

2. The interactive package according to claim 1, wherein said shell is made from plastic.

3. The interactive package according to claim 1, wherein said shell includes a front panel shaped to form said compartment and a rear panel.

4. The interactive package according to claim 3, wherein said front panel and said rear panel are made from plastic.

5. The interactive package according to claim 3, wherein said front panel is made from plastic and said rear panel is made from cardboard.

6. The interactive package according to claim 3, wherein said front and rear panels are made from paper.

7. The interactive package according to claim 1, wherein said shell includes structural reinforcement adjacent to said opening to prevent distortion of said shell.

8. In combination, an interactive package and an illuminating writing implement contained therein, said illuminating writing implement comprising:

an elongated body defining a longitudinal axis;

a top cap;

an LED;

a battery; and a push-button switch positioned in said top cap and movable along the longitudinal axis, said switch including an off position, wherein current does not flow between the battery and the LED, a momentary-on position, wherein current flows between the battery and the LED as long as the switch is depressed, and a locked-on position, wherein current flows between the battery and the LED;

said interactive package comprising:

a hollow shell defining a compartment which is sized and shaped to securely hold said illuminated writing implement along said longitudinal axis;

an opening within said shell and along said longitudinal axis, said opening being sized and shaped to receive a portion of said switch therethrough so that a portion of said switch will extend a predetermined distance outside said shell when said compartment holds said writing implement, said predetermined distance being sufficient to allow said switch to be depressed from outside said package from said off position to said momentary-on position, said predetermined distance being insufficient to allow said switch to be depressed to said locked-on position, said opening being sized and shaped to prevent passage of said body through said opening.

* * * * *